US010081115B2

(12) United States Patent
Van Cauwenberghe

(10) Patent No.: US 10,081,115 B2
(45) Date of Patent: Sep. 25, 2018

(54) BREAD SLICER WITH A THRUST MEANS AND A PUSHER DEVICE

(71) Applicant: JAC S.A., Liège (BE)

(72) Inventor: Baudouin Van Cauwenberghe, Liège (BE)

(73) Assignee: JAC S.A., Liège (BE)

( * ) Notice: Subject to any disclaimer, the term of this patent is extended or adjusted under 35 U.S.C. 154(b) by 0 days.

(21) Appl. No.: 15/299,643

(22) Filed: Oct. 21, 2016

(65) Prior Publication Data

US 2017/0113371 A1 Apr. 27, 2017

(30) Foreign Application Priority Data

Oct. 21, 2015 (BE) ..... 2015/5681

(51) Int. Cl.
*B26D 7/01* (2006.01)
*B26D 1/553* (2006.01)

(52) U.S. Cl.
CPC ..... *B26D 7/01* (2013.01); *B26D 1/553* (2013.01)

(58) Field of Classification Search
CPC ..... B26D 7/01; B26D 1/553
USPC ..... 83/437.2, 401, 418, 932, 858
See application file for complete search history.

(56) References Cited

U.S. PATENT DOCUMENTS 2,528,853 A 11/1950 Brustowsky
4,662,257 A * 5/1987 Petersen ..... B26D 1/553 83/407
4,686,875 A * 8/1987 Rijkaart ..... B26D 7/0608 83/425.2
4,759,168 A * 7/1988 Petersen ..... A21C 15/04 53/516
D545,615 S * 7/2007 Lin ..... B26D 1/553 D7/381
7,987,757 B2 * 8/2011 Willett ..... B26D 7/22 83/419
2006/0075859 A1 4/2006 Willett
2014/0208917 A1 * 7/2014 Whitney ..... B26D 5/16 83/858

FOREIGN PATENT DOCUMENTS

EP 2039483 A1 3/2009
EP 2801455 A1 11/2014
GB 538919 A 8/1941
GB 2242117 A 9/1991

* cited by examiner

*Primary Examiner* — Omar Flores Sanchez
(74) *Attorney, Agent, or Firm* — Browdy and Neimark, PLLC

(57) ABSTRACT

A bread slicer includes an input compartment for a loaf of bread to be sliced and an output compartment for the sliced loaf. Blades for slicing the loaf are arranged substantially parallel to one another between the compartments. A thrust means extends at least on the side of the input compartment and permits exertion of a push force on the loaf while the latter is moving through the set of blades by clamping the loaf between the thrust means and the base of the input compartment. The base and the thrust means define a passage in the input compartment for the loaf. The thrust means presents a guiding plate with parallel recesses extending next to each other over the width of the passage. A mobile pusher device allows exertion of a pushing force on the loaf to move the loaf along the passage and through the set of blades.

20 Claims, 2 Drawing Sheets

BREAD SLICER WITH A THRUST MEANS AND A PUSHER DEVICE

The invention concerns a bread slicer with an input compartment for at least one loaf of bread to be sliced and an output compartment for the sliced loaf, each comprising a base. In between said compartments, the slicer comprises a set of blades for slicing the loaf with blades that are arranged substantially parallel to one another.

A thrust means is provided, extending at least on the side of the input compartment and which makes it possible to exert a pushing force on the loaf while the latter is moving through the set of blades by clamping the loaf to be sliced between the thrust means and the base of the input compartment. This base of the input compartment and the thrust means define a passage to guide the loaf to be sliced towards the set of blades. The thrust means comprises a guiding plate having a succession of recesses extending parallel next to one another over the width of the passage.

The slicer also comprises a mobile pusher device making it possible to exert a pushing force on the loaf to be sliced so as to move it along the passage and through the set of blades. Said pusher device can be arranged in a retracted position, at least partially outside said passage, so as to set the latter free for introducing a loaf of bread in said passage.

Such a slicer has already been described in documents GB 538919, GB 2242117, US 2006/0075859 and EP 2039483.

The slicers described in those documents comprise a pusher device which can be positioned outside the passage according to which the loafs of bread are guided towards the set of blades. The construction and drive of these pusher devices are relatively complex and give rise to problems during their operation.

The invention aims to remedy these disadvantages by proposing a bread slicer with a pusher device having a relatively simple design and efficient operation. Moreover, the device according to the invention can be applied in a slicer which is fit for slicing several successive loaves of bread moving, by the force of gravity, towards the set of blades. The invention also makes it possible to build bread slicers which are very compact compared to the existing slicers.

To this end, according to the invention, the pusher device comprises a succession of fingers distributed parallel over the width of the passage and which can be moved through the recesses of the guiding plate so as to set the passage free for moving a loaf through this passage towards the set of blades or to come back from said retracted position towards the passage and to push a loaf through the set of blades.

Advantageously, the fingers of the guiding plate have free ends which can be moved from said retraced position into a position beyond the blades in which the fingers extend between two successive blades.

According to a particular embodiment of the invention, the far ends of the fingers, as opposed to their free ends, are fixed to a rotary shaft which cooperates with drive means to move the pusher device from said retracted position into a position in which the fingers pass through the recesses of the guiding plate and extend at least up to the set of blades and, preferably, between said blades.

According to an interesting embodiment of the invention, said base, extending in the input compartment, is inclined in such a way that a loaf of bread, placed on said base, will move in the direction of the set of blades by the force of gravity.

In an interesting manner, said guiding plate has parallel oblong strips, or tabs, which are separated from one another by said recesses, whereby said strips and fingers are alternately provided in a direction which is substantially parallel if the plane of the set of blades. A space is thereby provided between the strips and the adjacent fingers making it possible to insert a blade of the set of blades between an oblong strip and an adjacent finger.

Other details and particularities of the invention will become clear from the following description, given by way of example only without being limitative in any way, of a few particular embodiments of the machine according to the invention, with reference to the accompanying drawings.

In the different figures, the same reference numbers refer to analogous or identical elements.

The invention generally concerns an automatic machine for slicing one or several loaves of bread. This machine comprises an input compartment where the loaves to be sliced are introduced, separated by a set of blades from an output compartment. Thus, the loaves move through the set of blades, by which they are cut into slices, into the output compartment from which the sliced loaves can be removed.

Figure 1:
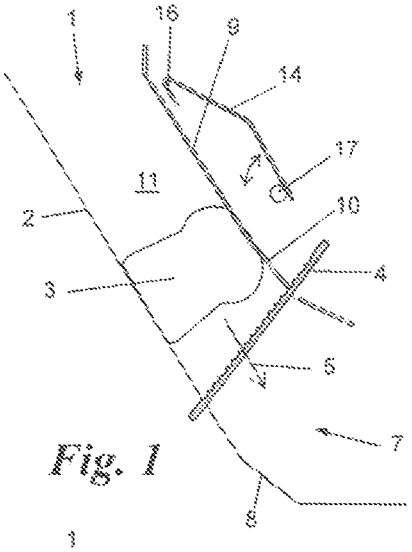
FIG. 1 show a schematic side view of the input compartment and the output compartment, according to the invention, while a loaf of bread is moving towards the set of blades in the input compartment and the pusher device is in the refracted position.
Figure 3:
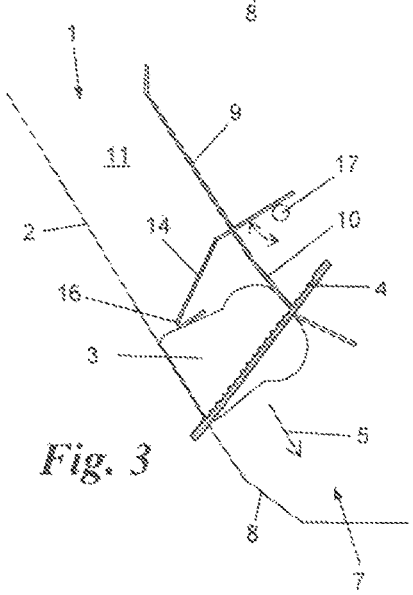
FIG. 3 is a view analogous to that in FIG. 1 during the slicing of the loaf while the pusher device is driving the loaf.
Figure 5:
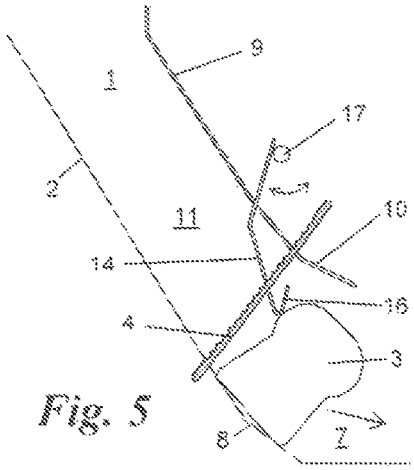
FIG. 5 is a view analogous to those in FIGS. 1 and 3 when the loaf has been sliced entirely and the fingers of the pusher device extend between the blades of the set of blades.

FIGS. 1, 3 and 5 schematically represent a side view of said compartments of the slicer according to the invention. The input compartment 1 comprises a base 2 which is inclined in relation to the horizontal plane, such that a loaf of bread 3 which is placed on the base 2 in the input compartment 1 will move by the force of gravity towards a set of blades 4, as indicated by the arrow 5.

Said set of blades 4 comprises blades 6 arranged substantially parallel to one another, which are subject to a back and forth movement in their longitudinal direction.

During the movement towards the set of blades 4, the loaf 3 slides onto said base 2 which has a smooth surface. Above said base 2, the slicer comprises a thrust means 9 for the loaf 3 which extends at least on the side of the input compartment 1 to exert a pushing force on the loaf 3 while the latter is moving through the set of blades 4. Thus, the loaf 3, while being sliced by the blades 6, is clamped between the thrust means 9 and said base 2 of the input compartment 1. Said base 2 and the thrust means 9 define a passage 11 in the input compartment 1 for guiding the loaf 3 towards the set of blades 4.

The thrust means 9 comprises a guiding plate 10 with a succession of parallel recesses 12 extending next to one another over the width of the passage 11, as represented in FIGS. 1 to 6. In this embodiment of the thrust means 9, the blades 6 of the set of blades 4 extend through the recesses 12. The guiding plate 10 thus represents parallel oblong strips or tabs 13 separated by the recesses 12. These strips 13 extend between the blades 6 up to the output compartment 7 and, therefore, have a width which is less than the distance between two successive blades 6.

As the loaf passes through the set of blades 4, it will enter the output compartment 7 downstream of the set of blades 4. The output compartment 7 also has a base 8 which extends in the extension of the base 2 of the input compartment 1 or at a somewhat lower level.

As the loaf is moving through the passage 11, its movement will be stopped as a result of a friction between the guiding plate 9 and the base 2 and/or as a result of its contact with the blades 6. In order to move the loaf 3 through the set of blades 4, a mobile pusher device 14 is provided which allows to exert a pushing force on the loaf 3 in the direction of the blades 6.

Said pusher device 14 comprises a succession of parallel fingers 15 distributed over the width of the passage 11. The fingers 15 have free ends 16 to push against the loaf 3 so as to move it forward through the set of blades 4. The width of the fingers 15, in a direction parallel to the plane of the set of blades 4, is smaller than the distance between two successive blades 6 so as to make it possible for the fingers 15 to extend through the set of blades 4 in order to push the loaf 3 beyond the blades 6 into the output compartment 7.

Figure 6:
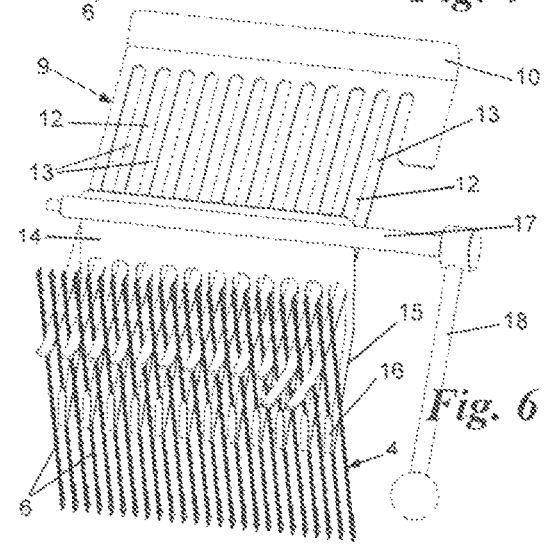
FIG. 6 is a view analogous to that in FIGS. 2 and 4 when the pusher device is in the position represented in FIG. 5.

The far ends of the fingers 15, as opposed to their free ends 16, are fixed to a rotary shaft 17 which cooperates with drive means making it possible to move the fingers 15 in the passage up to in between the blades 6. Said rotary shaft 17 extends substantially parallel to the base 2, to the guiding plate 10 and to the set of blades 4, and it is situated above the guiding plate 10 and outside the passage 11. The pusher device 14 can be moved in particular from a retracted position, in which the loaf 3 can freely move through the passage 11, and a position in which the fingers 15, in particular their free ends 16, pass through all the blades 4. In FIG. 1, the pusher device 14 is situated in said retracted position. FIGS. 5 and 6 show the position in which the fingers 15 extend through the set of blades 4.

As the pusher device 14 moves from its retracted position towards the position in which the free ends 16 of the fingers 15 are situated in the output compartment 7, the fingers 15 move through the recesses 12 between the strips or tabs 13 of the guiding plate 10.

The strips or tabs 13 and the fingers 15 are alternately provided in a direction substantially parallel to the plane of the set of blades 4. Between the strips or tabs 13 and the adjacent fingers 15 is provided a space which is sufficient to allow for the presence, in that space, of a blade 6 of the set of blades 4.

FIG. 1 shows a retracted position of the pusher device 14 in which the fingers 15 are all situated on the same side of the guiding plate 9 outside the passage 11. However, it is also possible for part of these fingers 15 to extend through the recesses 12 in that retracted position, as represented in FIG. 2, without said part disturbing the progress of a loaf of bread 3 through the passage 11.

Figure 4:
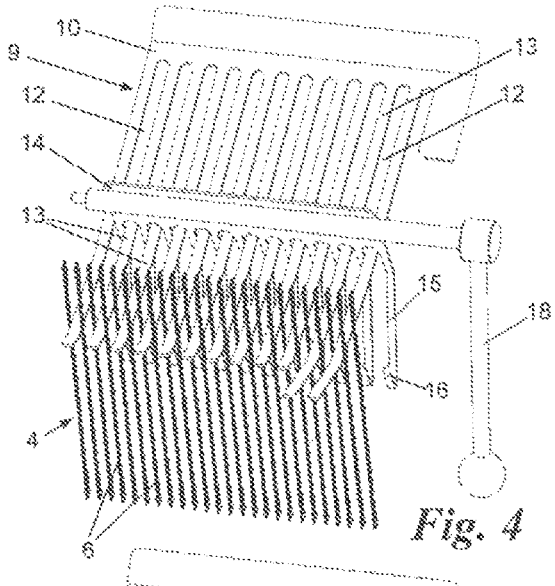
FIG. 4 is a view analogous to that in FIG. 2 when the pusher device is in the position as represented in FIG. 3.

When a loaf of bread 3 to be sliced arrives at the blades 6 while moving along the passage 11, the pusher device 14 will be driven as of its retracted position to put the free ends 16 of the fingers 15 into contact with the loaf 3, as shown in FIGS. 3 and 4, and to push the latter through the set of blades 4 so as to cut it entirely into slices.

Figure 2:
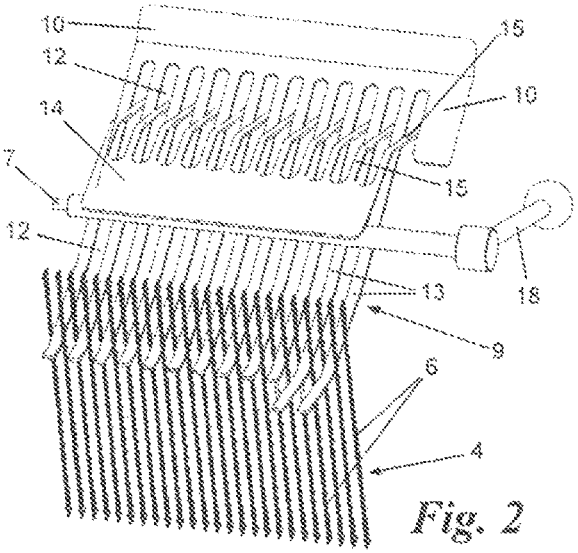
FIG. 2 is a schematic view in perspective of the set of blades, the thrust means and the pusher device when the latter is in the retracted position according to the invention.

As represented in FIGS. 2, 4 and 6, the rotary shaft 17 is connected to a hand lever 18, such that the pusher device can be activated by an operator. It is also possible for the shaft 17 to be provided with other drive means, such as for example an electric motor controlled by a sensor which detects the presence of a loaf of bread at the blades 6.

As soon as the loaf 3 has passed the set of blades 4, the pusher device is put back in its retracted position.

Since, according to the invention, the pusher device 14 can be arranged outside the passage 11 of the loaf of bread 3 and can be subjected to a movement through the thrust means 9, it is possible to build bread slicers which are very compact compared to conventional slicers wherein a push rod is provided which cannot pass the thrust means.

FIGS. 7 to 10 represent a bread slicer according to the invention by means of which one can slice several successive loaves of bread 3 as they are moving, by the force of gravity, in the direction of the set of blades 4.

Figure 7:
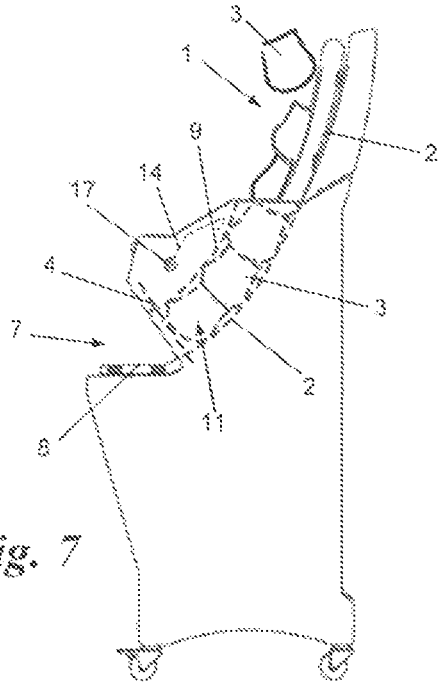
FIGS. 7 to 10 show a schematic side view of a bread slicer according to the invention for slicing several successive loaves moving by the force of gravity in the direction of the set of blades.
Figure 8:
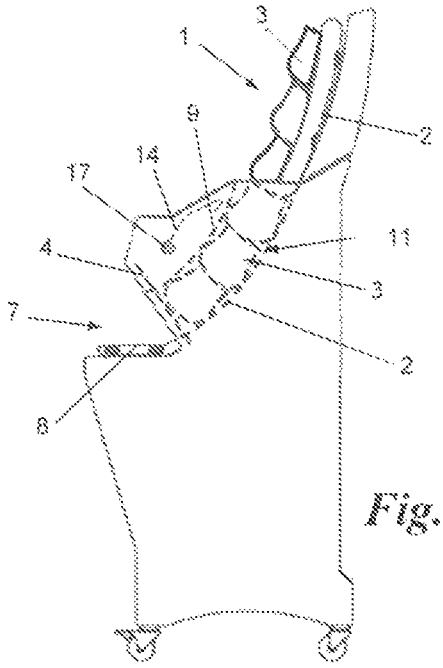
Figure 9:
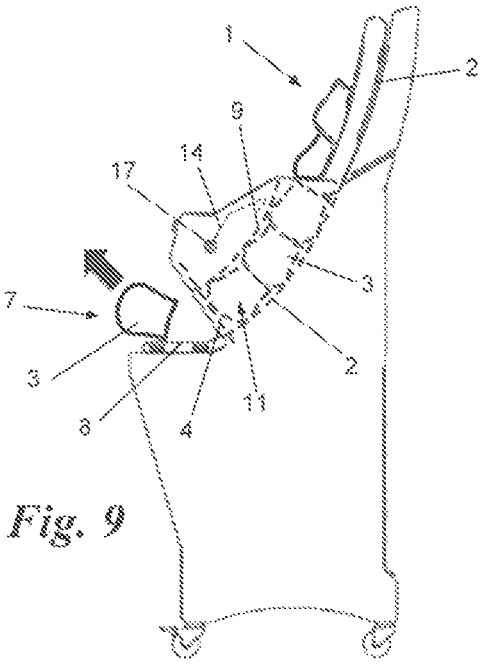
Figure 10:
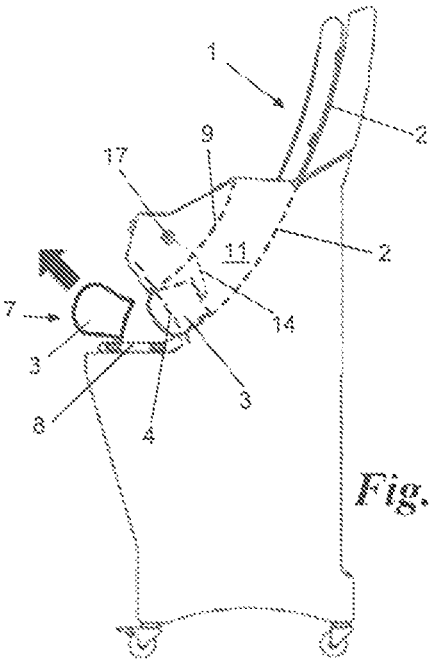

Said slicer comprises an input compartment 1 with a base 2 on which several loaves of bread 3 can be placed, as represented in FIGS. 7 and 8. When a loaf of bread is placed in the input compartment 1, the loaf will slide over the inclined base 2 up to the set of blades 4. Thus, a series of loaves 3 is loaded in the slicer, in which each successive loaf of bread 3 will lean on the preceding loaf 3 due to the force of gravity. Thus, the first loaf of bread 3 which is situated at the blades 6 will be pushed through the set of blades 4 by the weight of the successive loaves of bread 3 advancing in the direction of the blades 6 as the first loaf of bread 3 enters the output compartment 7.

When the last loaf of the series is situated in front of the blades 6, the operator will activate the pusher device 14 in order to make this last loaf pass through the set of blades 4, as described above, and to slice it, as shown in FIG. 10.

Naturally, the invention is not restricted to the embodiments described above and represented in the accompanying drawings; on the contrary, many other variants could be considered while still remaining within the scope of the invention.

Thus, for example, it is possible that the base 2 in the input compartment 1 is not inclined but extends in a substantially horizontal plane. In that case, an operator can introduce the loaf manually up to the set of blades 4 and then activate the pusher device to make the loaf pass through the blades 6 so as to slice it.

The pusher device must not necessarily be fixed to a rotary shaft 17, but it may also be provided with a system which subjects it to a translation, or a combination of a translation and a rotation, between the retracted position and the position in which the free ends 16 of the fingers 15 go through the set of blades 4.

In the embodiments of the slicer according to the invention described above, fingers 15 and strips or tabs 13 are alternately provided along the width of passage 11. It goes without saying that it is also possible that several strips or tabs 13 extend between two successive fingers 15 or that several fingers 15 extend in the recesses 12. Moreover, a strip or tab 13 or a finger 15 must not necessarily extend between two adjacent blades 6 as the loaf is being pushed through the set of blades 4.

The invention claimed is:

1. A bread slicer comprising an input compartment (1) for at least one loaf of bread (3) to be sliced and an output compartment (7) for the sliced loaf (3), each of the compartments (1,7) comprising a base (2,8), wherein the slicer comprises a set of blades (4) for slicing the loaf (3) with blades (6) arranged substantially parallel to one another between said input compartment (1) and said output compartment (7), wherein the sliced loaf (3) can be removed from the output compartment (7), a thrust means (9) being provided extending at least on the side of the input compartment (1) and the thrust means (9) enabling to exert a push force on the loaf (3) while the loaf is moving through the set of blades (4) by clamping the loaf (3) to be sliced between the thrust means (9) and said base (2) of the input compartment (1), wherein said base (2) and the thrust means (9) define a passage (11) in the input compartment (1) to guide the loaf (3) to be sliced towards the set of blades (4), said thrust means (9) comprising a guiding plate (10) with a succession of parallel recesses (12) extending one next to the other over the width of the passage (11), the slicer comprising a mobile pusher device (14) which allows to exert a pushing force on the loaf (3) to be sliced so as to move the loaf (3) along the passage (11) and through the set of blades (4), wherein the pusher device (14) can be arranged in a retracted position which is at least partially retracted outside said passage (11) so as to set free the passage (11) to allow for the movement of a loaf (3) in the passage (11), wherein the pusher (14) comprises a succession of fingers (15) substantially parallel distributed over the width of the passage (11), the fingers (15) being arranged such that they can be moved through the recesses (12) of the guiding plate (10).

2. The slicer according to claim 1, wherein the width of the fingers (15) of the pusher device (14), in a direction which is substantially parallel to the plane of the set of blades (4), is smaller than the distance between said blades (6).

3. The slicer according to claim 1, wherein the width of the recesses (12), provided in the guiding plate (10), is larger than the width of the fingers (15) in a direction which is substantially parallel to the plane of the set of blades (4).

4. The slicer according to claim 1, wherein the fingers (15) of the pusher device (14) have free ends (16) which can be moved through the set of blades (4) from said retracted position into a position beyond the blades (6), wherein the fingers (15) extend between two successive blades (6).

5. The slicer according to claim 1, wherein the guiding plate (10) extends on either side of the set of blades (4), wherein the blades (6) extend through the recesses (12) provided in the guiding plate (10).

6. The slicer according to claim 1, wherein the far ends of the fingers (15) opposed to the free ends (16) of said fingers (15), are fixed to a rotary shaft (17) which cooperates with drive means so as to move the pusher device (14) from said retracted position into a position wherein the fingers (15) go through the recesses (12) of the guiding plate (10) and extend at least up to the set of blades (4) and, preferably, between said blades (6).

7. The slicer according to claim 6, wherein the drive means comprises a hand lever (18) fixed to the rotary shaft (17) for driving the rotary shaft (17) about its axis.

8. The slicer according to claim 1, wherein said base (2), extending in the input compartment (1), is inclined in such a way that when a loaf of bread (3) is placed on said base (2), it will move, by the force of gravity, in the direction of the set of blades (4).

9. The slicer according to claim 1, wherein said guiding plate (10) has parallel oblong strips (13) which are separated from one another by said recesses (12), said oblong strips (13) and said fingers (15) being alternately provided in a direction which is substantially parallel to the plane of the set of blades (4), wherein a space is provided between the tabs (13) and the adjacent fingers (15) to allow for blades (6) of the set of blades (4) to be inserted between oblong strips and adjacent fingers.

10. The slicer according to claim 2, wherein the width of the recesses (12), provided in the guiding plate (10), is larger than the width of the fingers (15) in a direction which is substantially parallel to the plane of the set of blades (4).

11. The slicer according to claim 2, wherein the fingers (15) of the pusher device (14) have free ends (16) which can be moved through the set of blades (4) from said retracted position into a position beyond the blades (6), wherein the fingers (15) extend between two successive blades (6).

12. The slicer according to claim 3, wherein the fingers (15) of the pusher device (14) have free ends (16) which can be moved through the set of blades (4) from said retracted position into a position beyond the blades (6) wherein the fingers (15) extend between two successive blades (6).

13. The slicer according to claim 2, wherein the guiding plate (10) extends on either side of the set of blades (4), wherein the blades (6) extend through the recesses (12) provided in the guiding plate (10).

14. The slicer according to claim 3, wherein the guiding plate (10) extends on either side of the set of blades (4), wherein the blades (6) extend through the recesses (12) provided in the guiding plate (10).

15. The slicer according to claim 4, wherein the guiding plate (10) extends on either side of the set of blades (4), wherein the blades (6) extend through the recesses (12) provided in the guiding plate (10).

16. The slicer according to claim 2, wherein the far ends of the fingers (15) opposed to the free ends (16) of said fingers (15), are fixed to a rotary shaft (17) which cooperates with drive means so as to move the pusher device (14) from said retracted position into a position wherein the fingers (15) go through the recesses (12) of the guiding plate (10) and extend at least up to the set of blades (4) and, preferably, between said blades (6).

17. The slicer according to claim 3, wherein the far ends of the fingers (15) opposed to the free ends (16) of said fingers (15), are fixed to a rotary shaft (17) which cooperates with drive means so as to move the pusher device (14) from said retracted position into a position wherein the fingers (15) go through the recesses (12) of the guiding plate (10) and extend at least up to the set of blades (4) and, preferably, between said blades (6).

18. The slicer according to claim 4, wherein the far ends of the fingers (15) opposed to the free ends (16) of said fingers (15), are fixed to a rotary shaft (17) which cooperates with drive means so as to move the pusher device (14) from said retracted position into a position wherein the fingers (15) go through the recesses (12) of the guiding plate (10) and extend at least up to the set of blades (4) and, preferably, between said blades (6).

19. The slicer according to claim 5, wherein the far ends of the fingers (15) opposed to the free ends (16) of said fingers (15), are fixed to a rotary shaft (17) which cooperates with drive means so as to move the pusher device (14) from said retracted position into a position wherein the fingers (15) go through the recesses (12) of the guiding plate (10) and extend at least up to the set of blades (4) and, optionally, between said blades (6).

20. The slicer according to claim 2, wherein said guiding plate (10) has parallel oblong strips (13) which are separated from one another by said recesses (12), said oblong strips (13) and said fingers (15) being alternately provided in a direction which is substantially parallel to the plane of the set of blades (4), wherein a space is provided between the tabs (13) and the adjacent fingers (15) to allow for blades (6) of the set of blades (4) to be inserted between oblong strips and adjacent fingers.

* * * * *